United States Patent [19]

Thomas

[11] Patent Number: 4,548,112

[45] Date of Patent: Oct. 22, 1985

[54] WEB CUTTING

[75] Inventor: Richard H. Thomas, Phillips, Wis.

[73] Assignee: Marquip, Inc., Phillips, Wis.

[21] Appl. No.: 632,941

[22] Filed: Jul. 20, 1984

[51] Int. Cl.[4] ..... B26D 1/62

[52] U.S. Cl. ..... 83/345; 83/343; 83/663

[58] Field of Search ..... 83/345, 343, 663, 344, 83/346, 347, 348, 349, 674, 665, 339

[56] References Cited

U.S. PATENT DOCUMENTS

| | | | |
|---|---|---|---|
| 3,668,964 | 6/1972 | Lomas | 83/674 X |
| 3,683,734 | 8/1972 | Claussen | 83/345 |
| 3,946,629 | 3/1976 | Achelpohl | 83/345 X |
| 4,364,293 | 12/1982 | Hirsch | 83/663 X |

*Primary Examiner*—Donald R. Schran

*Attorney, Agent, or Firm*—Andrus, Sceales, Starke & Sawall

[57] ABSTRACT

A device for cutting successive sheets from a traveling web includes a pair of thin-walled knife-carrying cutting cylinders concentrically mounted over fixed supporting shafts. To prevent ringing of the shafts at high cutting frequencies, due to resonant frequency interference, each support shaft is formed by a body having an inperforate cylindrical wall. The cylindrical wall of the support shaft is closed at both ends to form an uninterrupted cylindrical cavity extending from end to end of the cylindrical wall. Furthermore, and to prevent poor cuts due to changes in the alignment of the cutting knives, the amplitude of vibrations occurring at the time of each cut is reduced. The cavity of the support shaft is filled with a flowable vibration damping material which is not firmly affixed to the cavity walls and thus forms no significant part of the mass of the support shaft.

7 Claims, 4 Drawing Figures

WEB CUTTING

U.S. PRIOR ART OF INTEREST

| U.S. Pat. No. | Inventor | Issue Date |
|---|---|---|
| 2,778,422 | Weber | January 22, 1957 |
| 3,683,734 | Claussen | August 15, 1972 |

BACKGROUND AND SUMMARY OF THE INVENTION

This invention relates to cutting a web of moving sheet material and more particularly to the cutting of a traveling continuous web into a plurality of separate sheets.

It is known to cut a longitudinally traveling continous web of paper or the like into separate sheets by means of a rotating cylinder extending transversely of the path of web travel and having a single axially extending knife thereon for cutting engagement with the web. Two such rotating cylinders, arranged on opposite sides of the web, have usually been utilized, with the oppositely rotating knives cooperating to provide the cut.

Heretofore, each rotating cylinder was often constructed either as a solid piece of metal or alternately as a thick-walled metal tube having a hollow axial bore and unsupported inner wall.

It has been desirable to reduce the forces of inertia involved especially with variable speed cutting cylinder drives. The above-identified U.S. patents disclose devices which will reduce the inertia. Such devices contemplate providing a rotatable cutting cylinder with a thin wall and which is disposed concentrically over a fixed solid cylindrical shaft-like core of heavy construction. In U.S. Pat. No. 3,683,734, a plurality of annular bearings are disposed between the cylinder and core and not only asist in cylinder rotation but also support the thin cylinder wall against distortion due to radial cutting forces. Other support concepts are disclosed in these patents as well.

It has been observed that, when mechanical supports are provided between the cylinders and solid cores of a dual cylinder arrangement, an unusual phenomenon occurs during high speed web cutting, such as that which requires a rotative speed of the cutting cylinder of from 150 to 300 rpm. The phenomenon comprises a high frequency ringing, such as a bell-like or piano string sound. Such ringing is accompanied by incomplete or ragged cuts of the traveling web. It has been found that increasing the overlap of the cutting knives will help overcome the poor cuts, but the knives then are subject to faster wear and the ringing has not been eliminated.

At relatively low rmp of the cutting cylinders, the ringing and incomplete cuts do not occur. Instead, they commence abruptly as the drive speed reaches a certain level.

It is a task of the present invention to find a solution to the aforementioned undesirable ringing and poor cuts, while at the same time permitting the knives to maintain their normal overlap and maintaining low inertia of the cutting cylinders.

The present invention is based on the discovery of the causes of the problem, and the development of a solution therefor.

In considering the problem, the inventor came to the conclusion that as the opposed knives came together for a single cut of the web, an inward radial force was created not only on the thin cutting cylinder, but also through the intermediate bearings to the solid inner support shaft. This caused minute short-term distortions of not only the cylinder, but also of the support shaft. As successive cuts are made, the shaft is subject to a plurality of distortion inducing forces. If this plurality of successive forces occurs at a rate close to the assembly's resonant frequency, the magnitude of the deflections increase.

As to the undesirable ringing which was believed to emanate from the solid support shaft, the inventor studied the concept of natural resonance of the cutting cylinder, the solid support shaft and the assembly of both. The resonant frequency of a body subject to vibrations is proportional to the mass of the body in accordance with the formula:

$$rf \sim 1/\sqrt{M}$$

where rf is the resonant frequency and m is the mass.

The mass of the thin-walled cutting cylinder is a relatively low and thus it has a relatively high resonant frequency above the cutting frequency. The mass of the solid supporting shaft is relatively high, resulting in a substantially lower natural frequency for the assembly cutting cylinder and support shaft, a frequency which is close to the frequency of distortions caused by successive cuts. This was determined to be the cause of the ringing sound during fast cutting.

At low rpm of the cutting cylinders, each single distortion from a single cut was of low amplitude and was damped out sufficiently by natural losses during rotation before the knives came together for the next cut. However, as the rpm increased, the frequency of the distortions increased to the point where a combination of radial and torsional oscillations occurred in the shaft, resulting in turbulant vibrations in the shaft. These vibrations were not damped out sufficiently between high frequency cuts. This was believed to be not only the cause of the ringing but also the cause of the cutting knives not coming together properly for a clean cut of the web.

With this discovey of the causes of the ringing sound and ragged cuts during high speed operation, the inventor has developed a solution to the problem.

Broadly, in accordance with the various aspects of the invention, it was determined that the ring could be minimized by increasing the natural resonant frequency of the assembly of the cylinder and supporting shaft to above the cutting frequency by substantially decreasing the mass of the support shaft. In addition, it was determined that the ragged cuts could be substantially eliminated by damping the amplitude of vibrations of the support shaft during high speed cuts so that the vibrations caused by each successive cut are isolated and do not compound each other in the shaft to change the knife alignment.

More specifically, the support shaft is formed by a body having an imperforate cylindrical wall approximating the thickness of the thin wall of the cutting cylinder. The cylindrical wall of the support shaft is closed at both ends to form an uninterrupted cylindrical cavity extending from end to end of the cylindrical wall. In addition, the cavity of the support shaft is filled with a flowable vibration damping material which is not firmly affixed to the cavity walls and thus forms no significant part of the mass of the support shaft.

BRIEF DESCRIPTION OF THE DRAWINGS

The accompanying drawings illustrate the best mode presently contemplated by the inventor for carrying out the invention.

In the drawings:

FIGS. 1–3 schematically illustrate the general concept of cutting separate sheets in succession from a traveling continous web 1 of sheet material. Rotatably driven upper and lower cutting cylinders 2 and 3 are disposed transversely of web 1 with the cylinders having on their surfaces axially extending knives 4 and 5 respectively. Knives 4 and 5 extend at a slight angle to their cylinder axes in helical fashion. To compensate for this so that the cutting path is exactly normal to the web path, cylinders 4 and 5 are skewed slightly as shown in FIG. 3.

Figure 2:
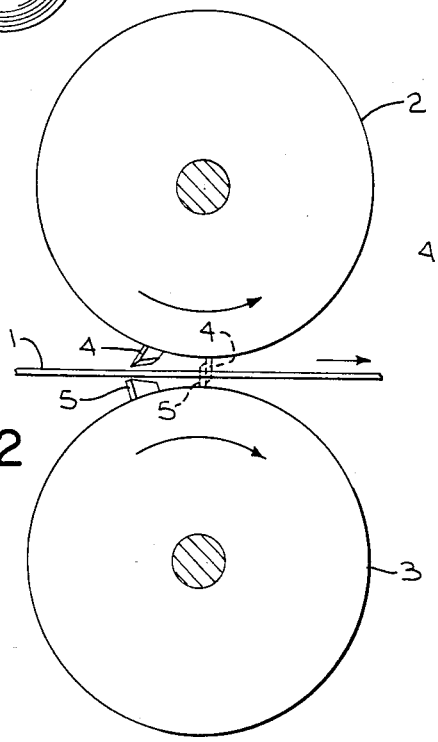
FIG. 2 is an enlarged end view showing the cutting of the web by a pair of cutting cylinders.

As the cylinders rotate in opposite directions, knives 4 and 5 approach each other a bit ahead of dead center, as shown in full lines in FIG. 2. They then engage and cut the web with a shearing action, as shown in dash lines.

Figure 1:
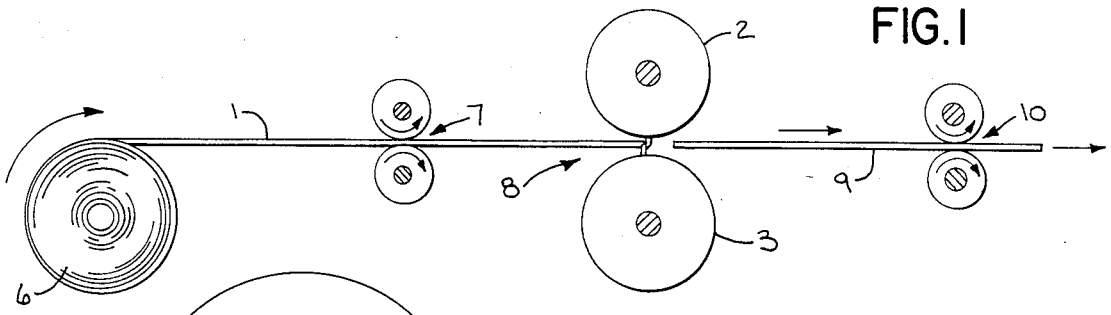
FIG. 1 is schematic showing of a device for cutting separate sheets in succession from a traveling continuous web.
Figure 3:
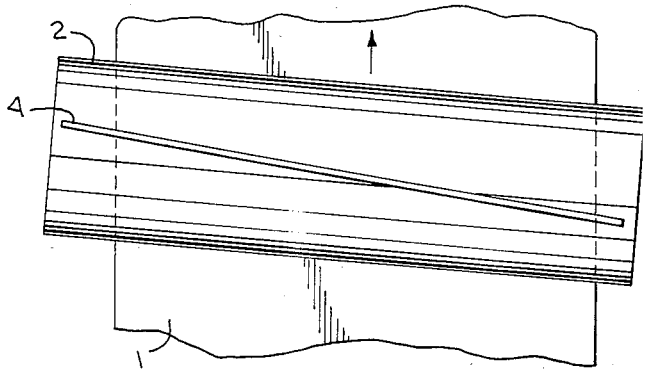
FIG. 3 is a schematic top plan view of the web showing the orientation of a cutting cylinder.

FIG. 1 shows a web 1 being continuously fed from a supply roll 6 of paper, paperboard or the like through a nip 7 to a cutting station 8 formed by cylinders 2 and 3. Knives 4 and 5 cut web 1 into successive sheets 9 which are then discharged through a further nip 10.

Figure 4:
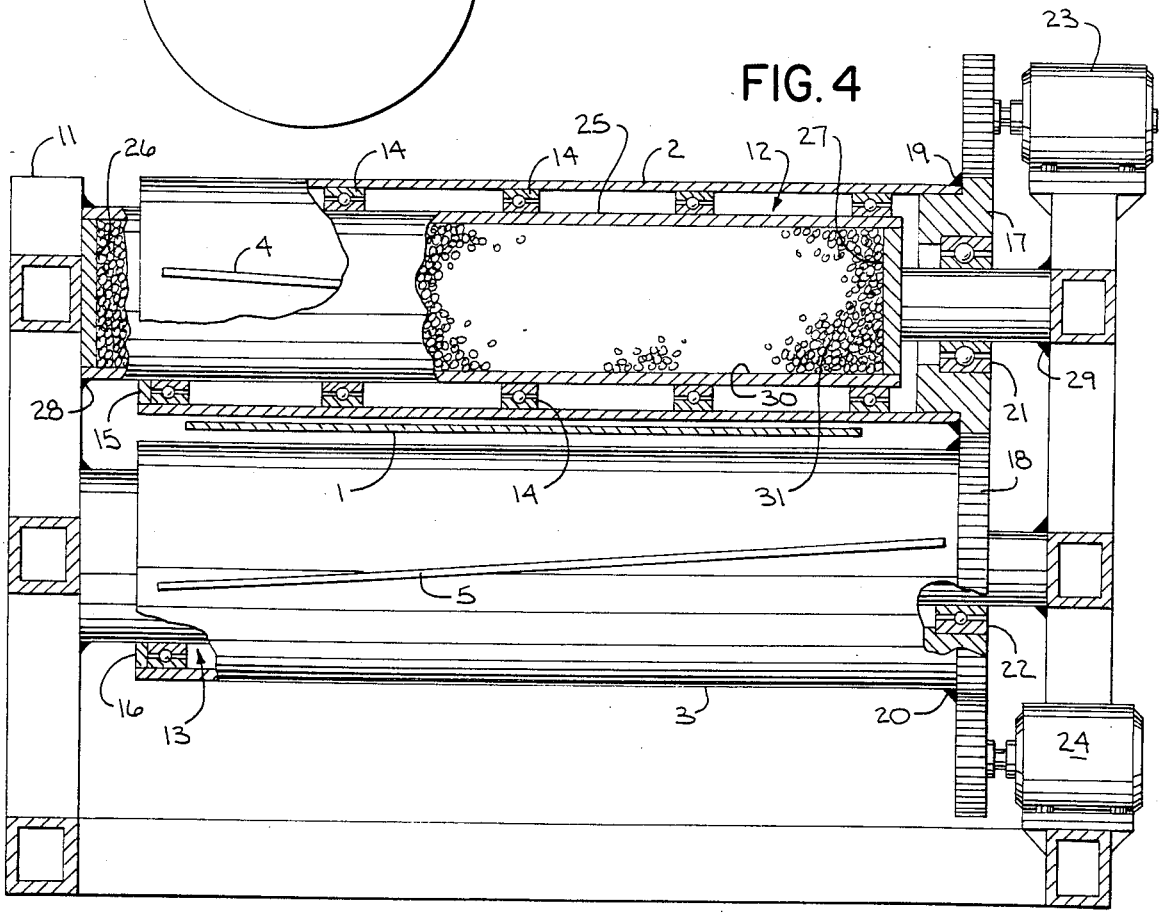
FIG. 4 is a schematic view transverse of a traveling web and showing a web cutting device constructed in accordance with the various aspects of the invention.

FIG. 4 illustrates a machine incorporating the present inventive concepts and includes a frame 11 for supporting the various elements above the floor. A pair of upper and lower cylindrical shafts 12 and 13 are fixedly mounted in parallelism to frame 11 with web 1 disposed therebetween. Cutting cylinders 2 and 3 are mounted concentrically over the respective shafts 12 and 13 to form a pair of cutting assemblies and comprise hollow elongated tubular sleeves. Cylinders 2 and 3 are shown as having mounted thereon web cutting knives 4 and 5 respectively. The pair of cylinders are spaced from their respective shafts and assisted in their rotation thereabout by support means disposed therebetween. In the present embodiment, the support means comprises a plurality of axially spaced annular internal bearings 14 which serve to partially support the thin-walled tubes against inward radial forces during web cutting.

Annular seals 15 and 16 close one end of the space between the knife cylinders and shafts.

Timing gears 17 and 18 are press fit into the other ends of the respective cylinders 2 and 3 and are secured thereto as by welds 19 and 20. Gears 17 and 18 ride on respective bearings 21 and 22 on end portions of the respective shafts 12 and 13 and are shown as meshing. Motive means are provided to rotate knife cylinders 2 and 3 for cutting web 1. This is shown in FIG. 4 as separate variable speed motors 23 and 24 respectively, which are controlled in any well-known manner.

As was previously described in connection with solid support shafts, at high rotative velocities of cylinders 2 and 3 an undesirable ringing sound emanated from the shafts together with incomplete cuts by knives 4 and 5. In such prior constructions, and in accordance with the aforementioned formula $rf \sim 1/\sqrt{M}$, the resonant frequency of the assembly tended to be undesirably disposed very close to the cutting frequency due to the high mass of the shafts. Furthermore, knives 4 and 5 provided uneven cuts due to turbulant vibrations of the shafts during high frequency cutting.

In accordance with the various aspects of the invention, support shafts 12 and 13 are each formed to provide means to raise the resonant frequency of the shafts and thereby raise the resonant frequency of the cutting assembly. For this purpose, and referring to cutting shaft 12, the shaft mass is lowered by forming it of a thin-walled cylinder 25 with the wall being imperforate. Plugs 26, 27 are sealingly secured within the ends of cylinder 25. Plug 26 is shown as fixedly secured to frame 11 as by welds 28. Plug 27 is reduced in diameter and passes through bearings 21 for affixing to frame 11, as by welds 29. The resultant construction provides a fully enclosed enlarged cavity 30 which extends uninterruptedly from end to end of cylinder 25 between plugs 26 and 27.

The construction of shaft 13 is shown as being indentical to shaft 12.

By constructing shafts 12 and 13 in the manner described, their masses are substantially reduced with a resultant increase in their resonant frequency. The resonant frequency of each shaft and knife supporting cylinder assembly thus is higher than the vibratory frequency created by the respective knife during high speed cutting of successive sheets 9, and ringing effects are minimized.

It has been found that for example, with a cutting frequency of knives 4, 5 of about 6 Hz and a mass of a shaft 12, 13 of the type of the present invention of about 50 slugs, the resonant frequency of the shaft will be about 50 Hz.

Further in accordance with the various apsects of the invention, means are provided to dampen the amplitude of the oscillatory vibrations of the low mass support shafts 12, 13 during high speed cutting, to the point where a vibration caused at the time of each cut is substantially completely terminated before the next cut is made. For this purpose, each cavity 30 is tightly fitted with a flowable semi-solid damping material 31 which is unattached to and mechanically independent or free from its support shaft 12 or 13 and thus does not materially affect the shaft mass or its resonant frequency. Such damping material may comprise, for example, sand or a combination of lead shot and thick viscous oil which will absorb the energy of the distorting vibrations to prevent compounding thereof. The result is the prevention of distortion of shafts 12 and 13 and the resultant separation of knives 4 and 5 to thereby provide clean cuts, especially at high rotative speeds (providing a given cutting frequency) on the order of 150 to 300 rpm.

Shafts 12 and 13 may each be assembled by securing a plug 26 thereinto, turning the shaft vertically and pouring damping material 31 into the open top end, securing plug 27 to the top end to sealingly enclose material 31, and then mounting the shaft to frame 11.

While the concepts of the invention appear relatively simple in restrospect, they provide a marked improvement in operation of web cutting devices of the type disclosed in the aforementioned patents, and solve problems of ringing and poor cutting.

Various modes of carrying out the invention are contemplated as being within the scope of the following claims particularly pointing out and distinctly claiming the subject matter which is regarded as the invention.

I claim:

1. A device for cutting a plurality of individual sheets in succession from a longitudinally traveling continous web of material, comprising:

(a) a frame, (b) a pair of elongated tubular cutting cylinders having engageable knives on the walls thereof for cutting the web, (c) support shafts disposed concentrically within said cutting cylinders and fixedly connected to said frame, (d) support means disposed internally of said cutting cylinders and mechanically connecting said cylinders and said shafts, (e) said means to rotatably drive said cutting cylinders at a rotative speed providing a given cutting frequency, thereby producing vibrations at the moment of each cut by said knives which are transmitted to said shafts, (f) each said support shaft comprising an imperforate thin-walled closed-ended cylinder, forming an enlarged closed cavity extending from end-to-end therein so that the resonant frequency of each assembly of shaft and cutting cylinder is maximized relative to said cutting frequency.

2. The device of claim 1 which includes: means disposed within said cavity and unattached to and mechanically free of said support shaft to dampen the amplitude of cutting vibrations so that they are isolated between successive cuts.

3. The device of claim 2 wherein said amplitude dampening means comprises a flowable semisolid material.

4. The device of claim 3 wherein said amplitude dampening means comprises sand.

5. The device of claim 3 wherein said amplitude dampening means comprises a combination of lead shot and thick viscous oil.

6. The device of claim 1 in which the mass of said support shafts provides a resonant frequency thereof, in accordance with the formula $$rf(\text{resonant frequency}) \sim 1/\sqrt{M(\text{MASS})}$$

which is higher than the said cutting frequency.

7. The device of claim 6 in which said cutting frequency is about 6 Hz, said mass is about 50 slugs and said resonant frequency is about 50 Hz.

* * * * *